United States Patent [19]

Kapetanakos et al.

[11] Patent Number: 4,481,475

[45] Date of Patent: Nov. 6, 1984

[54] BETATRON ACCELERATOR HAVING HIGH RATIO OF BUDKER PARAMETER TO RELATIVISTIC FACTOR

[75] Inventors: Christos A. Kapetanakos, Bethesda; Phillip Sprangle, Silver Spring, both of Md.

[73] Assignee: The United States of America as represented by the Secretary of the Navy, Washington, D.C.

[21] Appl. No.: 405,465

[22] Filed: Aug. 5, 1982

[51] Int. Cl.[3] ..... H05H 11/00

[52] U.S. Cl. ..... 328/237

[58] Field of Search ..... 328/237; 313/62, 359, 313/154

[56] References Cited

U.S. PATENT DOCUMENTS

| | | | |
|---|---|---|---|
| 2,698,384 | 12/1954 | Wideroe | 328/237 |
| 3,377,563 | 4/1968 | Gratreau | 328/237 |
| 3,975,689 | 8/1976 | Geizer et al. | 328/237 |

OTHER PUBLICATIONS

*Journal of Applied Physics*, vol. 47, Oct. 1976, pp. 4881–4884, "Effect of High $\nu/\gamma$ Electron Beams for Collective Ion Acceleration" by Straw and Miller.

*Primary Examiner*—Palmer Demeo
*Assistant Examiner*—Sandra L. O'Shea
*Attorney, Agent, or Firm*—Robert F. Beers; William T. Ellis

[57] ABSTRACT

A betatron for accelerating charged particles in a toroidal vacuum chamber comprising a betatron magnetic field generator;

a toroidal magnetic field generator;

a generating circuit for generating a charged particle beam into the toroidal chamber with an energy and current such that the ratio of the Budker parameter $\nu$ to the relativistic factor $\gamma$ of the beam in the range $\nu/\gamma=0.005$ to 0.25 so that the toroidal field effects are significant and act to stabilize the beam, with the beam generation initiated at a point in the betatron magnetic field cycle where the betatron field is slightly less than the field equilibrium value for the beam;

a circuit disposed in the toroidal chamber for reducing the local betatron field in the toroidal chamber only during the beam trapping stage while maintaining the average flux constant inside the beam orbit to prevent collision with the beam generation circuit after the first bounce; and a coil circuit disposed such that its axis is approximately coincident with the major axis of the toroid for generating a time varying magnetic field in a direction approximately perpendicular to the plane of the toroid to thereby induce an electric field to oppose the electric field induced by the diffusion of the self magnetic field.

19 Claims, 8 Drawing Figures

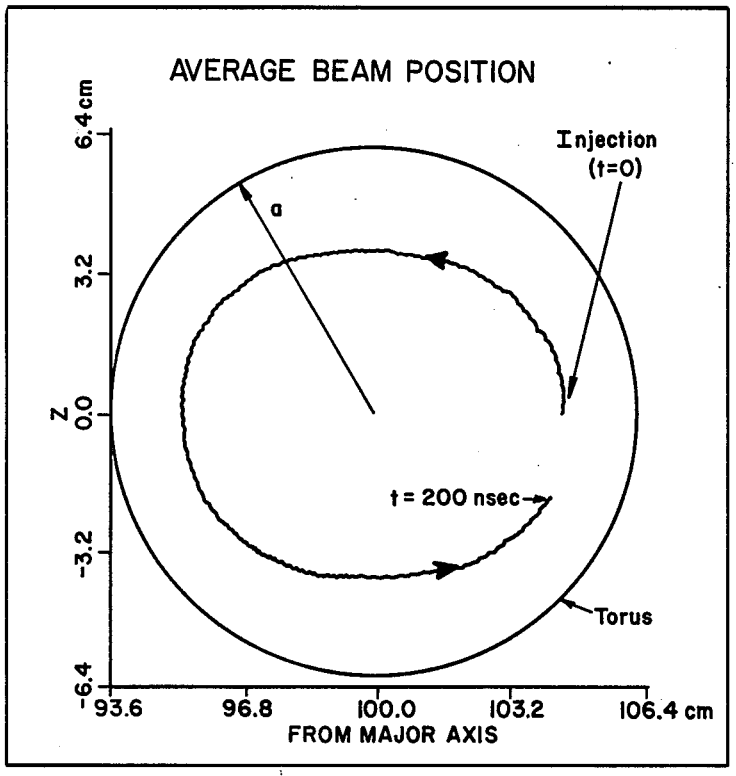

I = 10 kA (Beam current)

E = 3.84 MeV ($\gamma_0$ = 8.5) (Beam energy at the diode)

E = 3.05 MeV ($\gamma$ = 6.97) (Beam energy after injection)

r = 104.5 cm (Injection position)

$r_b$ = 1 cm (initial) (Beam minor radius)

$r_b$ = 1.2 cm (final) (Beam minor radius)

$B_{oz}$ = 146 G (Betatron magnetic field)

$B_{oz}^{eq}$ = 152 G (Equilibrium Betatron field)

$B_{o\theta}$ = 1415 G (Toroidal magn. field)

a = 6.4 cm (Torus minor radius)

FIG. 3

MODIFIED BETATRON (Fluxless injection)

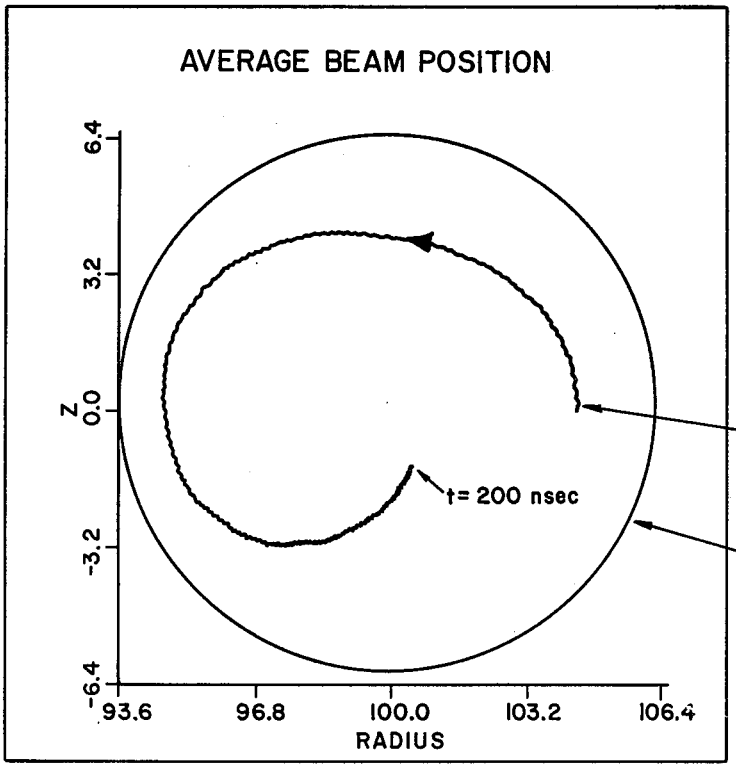

$B_\theta$ = 1415 G $B_z$ = 146 → 144 G

E = 3 MeV

I = 10 kA

Injection beam (t=0)

Vacuum chamber

FIG. 4

| I | II | III | IV | | |
|---|---|---|---|---|---|
| $(t/t_a = 3\times10^{-5})$ | (.002) | (.018) | (.98) | | |
| $\gamma = 7$ | 3.5 | 3.61 | 4.7 | 5.8 | 113 |
| $B_{oz}=80$ | 80 | 82.5 | 107.5 | 132.5 | 2,582 G |
| $\nu/\gamma=0.08$ | 0.168 | 0.163 | 0.125 | 0.10 | 0.005 |

BETATRON ACCELERATOR HAVING HIGH RATIO OF BUDKER PARAMETER TO RELATIVISTIC FACTOR

BACKGROUND OF THE INVENTION

The present invention relates generally to high current, charged particle accelerators, and more particularly to high current, betatron accelerators.

High current, high energy charged particle beams have a variety of potential applications in, for example, directed energy systems, in the excitation of free electron lasers, and in fusion-related applications. Over the last fifty years, several charged particle cyclic accelerators have been developed that are capable of generating charged particle beams with energies in excess of 10 MeV. The most prominent of these accelerators are the betatron, synchrontron, and the microtron accelerators. However, the peak current of these accelerators is usually under one ampere. This limit on the current is imposed primarily by the space charge of the beam that either makes the orbits of the gyrating particles unstable or acts to drive catastrophic collective instabilities.

The present invention is directed toward a modified betatron design. Betatron accelerators generally comprise an annular or toroidal vacuum chamber with a time-varying magnetic field, referred to as the betatron field, disposed relative to the toroidal chamber for the purpose of accelerating charged particles injected in the chamber. Typically, the strength of this betatron field is designed to be maximal along the major axis of the toroid and is designed to decrease with radial distance. Accordingly, electrons injected tangentially are accelerated at a constant radius by this betatron field into a privileged orbit known as the "betatron orbit".

Typically, the current and energy of the charged particle beam injected into the toroidal chamber is low such that the ratio of the Budker parameter ($\nu$) to the relativistic factor ($\gamma$) is on the order of $10^{-5}$. Injection at these low energies results in most of the charged particles of the injected beam striking the walls of the toroidal chamber during the first revolution within the toroid. This beam loss can be understood through the following equation relating the major radius of rotation r of the beam to the injected energies.

$$r=v/(eB_z/mc\gamma),$$

where v is the velocity of the particle, $B_z$ is the betatron field, m is the mass of the injected particle, and $\gamma$ is the relativistic factor that is proportional to the beam energy. From this equation, it can be seen that as the relativistic factor ($\gamma$) becomes smaller in order to provide energy to build-up the fields inside the vacuum chamber, the major radius of revolution r will also become smaller. Thus, as the beam of charged particles loses energy and $\gamma$ decreases, the radius will decrease and the individual charged particles in the beam will strike the walls of the toroid. A variety of different techniques have been formulated to prevent this loss of charged particles to the chamber walls. However, none of these techniques have been entirely successful and thus the trapping efficiency of the injected beam has remained small.

OBJECTS OF THE INVENTION

Accordingly, it is an object of the present invention to significantly increase the circulating current of the charged particle beam in a betatron.

It is a further object of the present invention to provide an injection and trapping scheme for generating and maintaining a high current beam with a high $\nu/\gamma$ ratio in a betatron.

It is yet a further object of the present invention to provide a betatron and injection scheme therefor which will satisfy the necessary conditions to obtain stable equilibrium states for the high current beams generated therein.

It is another object of the present invention to prevent the loss of equilibrium of the beam while its self magnetic field is differing out of the betatron toroidal vacuum chamber.

It is yet a further object of the present invention to cancel decelerating electric fields generated from the diffusion of the self-magnetic field of the high energy beam.

Other objects, advantages, and novel features of the present invention will become apparent from the detailed description of the invention, which follows the summary.

SUMMARY OF THE INVENTION

Briefly, the invention comprises a modified betatron design and a unique high current-high energy beam generation and trapping scheme therefor. The modified betatron structure comprises a torus with circuitry in combination therewith for generating a betatron magnetic field, circuitry for modifying the local vertical field $B_z$ during the trapping stage while maintaining the average flux inside the orbit constant, circuitry for generating a toroidal magnetic field $B_\theta$, and circuitry for generating a field to oppose the induced electric field from the diffusion of the self magnetic field of the beam. The torus of the betatron includes structure for generating the beam therein. The current and energy of the generated beam are set so that the ratio of the Budker parameter $\nu$ to the relativistic factor of the beam is in the range $\nu/\gamma=0.005$ to 0.25.

The beam generation and trapping scheme of the present invention comprises:

generating a toroidal magnetic field within the toroidal chamber;

generating a betatron accelerating magnetic field relative to the toroidal chamber;

generating a charged particle beam at a point in the betatron magnetic field cycle where the betatron field is slightly mismatched from the field equilibrium value for the beam, with the generated beam having a Budker parameter $\nu$ to relativistic factor $\gamma$ ratio in the range $\nu/\gamma=0.005$ to 0.25;

modifying the betatron magnetic field in the toroidal chamber while maintaining the average flux inside the orbit approximately constant to avoid collision with the beam generation circuitry after a bounce period; and terminating the modification of the betatron magnetic field after trapping.

It has been found that by using this unique generation and trapping scheme is combination with a high current-high energy charged particle beam, the beam will miss the generation circuitry after the first revolution and then will drift over a period of 10–20 revolutions toward the inner wall of the torus and then back to its generation point. As the beam drifts or bounces back toward its generation point, the toroidal magnetic field $B_\theta$ in conjunction with fields generated on the torus walls will cause the beam to move laterally and become trapped thereby allowing the beam to avoid the beam generation components disposed at its generation point.

Once the beam has been trapped the betatron field is matched to the beam current. Then, at a predetermined time approximately coincident with the beginning of the diffusion of the beams self magnetic field out of the toroidal chamber and the induced electric field attendant thereto, generating a field in the toroidal chamber to oppose the induced electric field attendant to the magnetic field diffusion, and then terminating this field when the induced electric field goes approximately to zero.

It should be noted that the energy spread attendant to the use of a high $\nu/\gamma$ beam acts to stabilize the beam in its orbits. In fact, it may be desirable to induce additional energy spread in the beam to obtain further stabilization thereof.

BRIEF DESCRIPTION OF THE DRAWINGS

FIG. 3 shows the projection of the orbit of the center of the rotating beam in a minor cross section of the torus, i.e., in a r-z plane for a standard betatron configuration.

FIG. 4 shows the projection of the orbit of the center of the rotating beam in the r-z plane using the present injection scheme.

FIG. 8 is a cross-sectioned view of the toroid showing the parameters $r_o$, $R_b$, r, $r_b$ and a.

DETAILED DESCRIPTION OF THE PREFERRED EMBODIMENT

Figure 1:
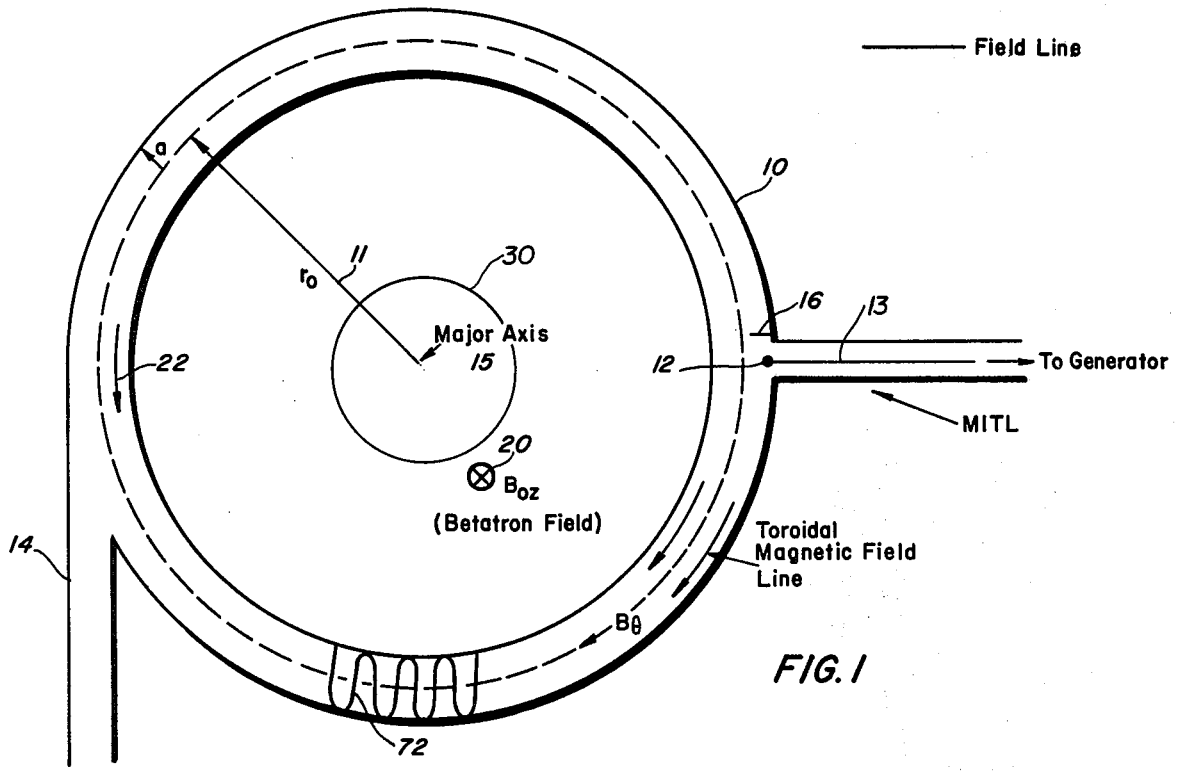
FIG. 1 is a sectioned top view of a modified betatron toroid.

The present invention is directed to a method and a means for substantially increasing the current/injection energy ratio $\nu/\gamma$ while retaining a stable charged-particle beam. Thus, the dynamics of an intense charged particle ring will be considered in order to understand the various design features disclosed in the invention. The present design will be discussed in relation to a modified betatron accelerator. Referring now to the drawings, wherein like reference characters designate like or corresponding parts throughout the views, FIG. 1 shows a modified betatron which may be utilized to implement the present invention. This modified betatron comprises a toroidal vacuum chamber 10 with a major radius $r_o$ designated 11. The chamber 10 should have thin walls, typically on the order of a few mils, and preferably of a resistive material such as stainless steel, to permit the penetration of the external magnetic field into the chamber.

A high current-high energy charged particle beam is generated within the toroidal vacuum chamber 10 by means of a cathode 12 connected by line 13 to a very high negative voltage generator (not shown) and a grounded anode 16 disposed in the chamber itself. An exit port 14 is taken off of one wall of the toroidal chamber for removing the accelerated charged particle beam resulting from propagation in the toroidal chamber 10. This charged particle beam may be extracted through the exit port 14, by way of example, by passing the beam through a field-free region obtained by energizing a set of field annihilation coils (not shown). This operation results in the unwrapping of the gyrating particle ring into a pencil-like beam.

The charged particle beam injected into the toroidal chamber 10 is accelerated by means of a betatron magnetic field 20 which is disposed vertically with respect to the plane of the toroidal chamber 10. Acceleration of the charged particle beam is achieved by varying the betatron magnetic field 20 with time in order to generate an inductive electric field. The instantaneous value of this betatron field $B_z(t)$ serves as a means for guiding the particles inside the toroidal chamber and as a focusing field for limiting the amplitude of particle oscillations around their instantaneous equilibrium orbit. However, the focusing effect of this betatron magnetic field is typically not enough to prevent most of the charged particles from the gun from being lost on the chamber walls during the first revolution of the beam due to beam cross-section expansion caused by repulsive space charge forces (electrostatic repulsion) in the beam.

In order to increase the stability of the accelerated charged particle beam and to compensate for the repulsive space charge forces a strong toroidal or azimuthal magnetic field 22 is applied in the toroidal chamber 10. The addition of this toroidal magnetic field permits the number of electrons that can be contained in the modified betatron to greatly exceed the number of electrons in a conventional betatron without such a toroidal field. Moreover, this toroidal magnetic field 22 improves the stability of the ring with respect to several unstable modes, including the negative mass and transverse wall resistive instabilities.

In order to generate the betatron field $B_z$, vertical field coils are disposed in planes above and below the mid plane of the toroid 10. When these coils are energized, a time varying magnetic field 20 is achieved. Likewise, in order to generate a toroidal field $B_\theta$, toroidal field coils 72 wrapped around the minor cross-section of the toroidal chamber 10 and cause a magnetic field to be generated following azimuthally through the toroidal chamber 10.

As noted previously, it is a primary purpose to increase the circulating current in a betatron accelerator. To this end, it is necessary to significantly increase the current of the beam generated in the toroidal chamber. To date, the prior art has utilized current-to-injection energy ratios $\nu/\gamma$ not much greater than $10^{-5}$. In this mathematical statement $\nu$(Nu) is the Budker's parameter and is equal to the number of electrons per unit length times the electron classical radius and $\gamma$ is the relativistic factor, i.e., the ratio of the electron mass to its mass at rest. The relativistic factor $\gamma$ is related to the kinetic energy (w) of a moving electron by the expression $$w = m_o c^2(\gamma - 1),$$

where $m_o$ is the rest mass of the electron and c is the speed of light in vacuum. The ratio $\nu/\gamma$ is also equal to $$\frac{I}{17 \times 10^3 \gamma (V/c)}$$

where I is the electron beam current and $\nu$ is the beam propagation speed, which for all practical purposes is equal to c for the conditions of the present device. The present device is designed for a $\nu/\gamma$ ratio on the order of 0.1.

If the current of the injected beam is high two very important complications arise. The first is related to the reduction of the kinetic energy of the injection beam or its $\gamma$ (inductive effect) and the second is related to the additional force that appears on the geometric center of the beam. The kinetic energy reduction effect occurs in order to provide the necessary energy to buildup the self electric and magnetic fields for the beam due to the law of conservation of energy. These self electric and magnetic fields for high currents can be quite significant and are typically much greater than the external B fields. The reduction in the kinetic energy evidenced by a decrease in $\gamma$ will result in a decreasing beam major radius $r_o$. Thus, it is likely that the beam will strike the inner wall after propagating a short distance.

The additional force noted above has its origin in the self fields and the finite curvature of the circulating electron beam (toroidal effect). In particular, due to the toroidal shape of the charged particle beam, neither the self E field or the self magnetic field of the beam will go to zero at the center of the beam. The resultant fields will cause a force in accordance with the standard force equation $F=q(\vec{E}+\vec{V} X \vec{B})$ which will act to, in general, increase the major radius of the beam. It can be seen that both of these effects individually can drastically change the major radius of the electron ring and thus drive the injected beam to the wall of the vacuum chamber.

The present invention discloses a new, single pulse injection scheme that is appropriate for injection into high current modified betatrons. In the proposed injection scheme a high current high energy electron beam is generated inside the torus 10, as shown in FIG. 1, by a conventional pulse generator. The cathode 12 of the generator is located in the midplane of the torus but away from its minor axis. It has been discovered that when $1/\gamma^2$ is much less than unity and the major radius of the torus $r_o$ is much greater than its minor radius, then inductive and toroidal effects balance each other, even when the injected beam is off axis.

As a result of the balancing of these two effects, the center of the beam will remain stationary in time if the betatron field at the point of injection is equal to the equilibrium field $B_z(R_6)$ where $$B_z(R_b) = \frac{c^2 \gamma_o m_o}{|e|\, R_b}.$$

where $R_b$ is the radial distance from the major axis 15 to the injection point.

Figure 2:
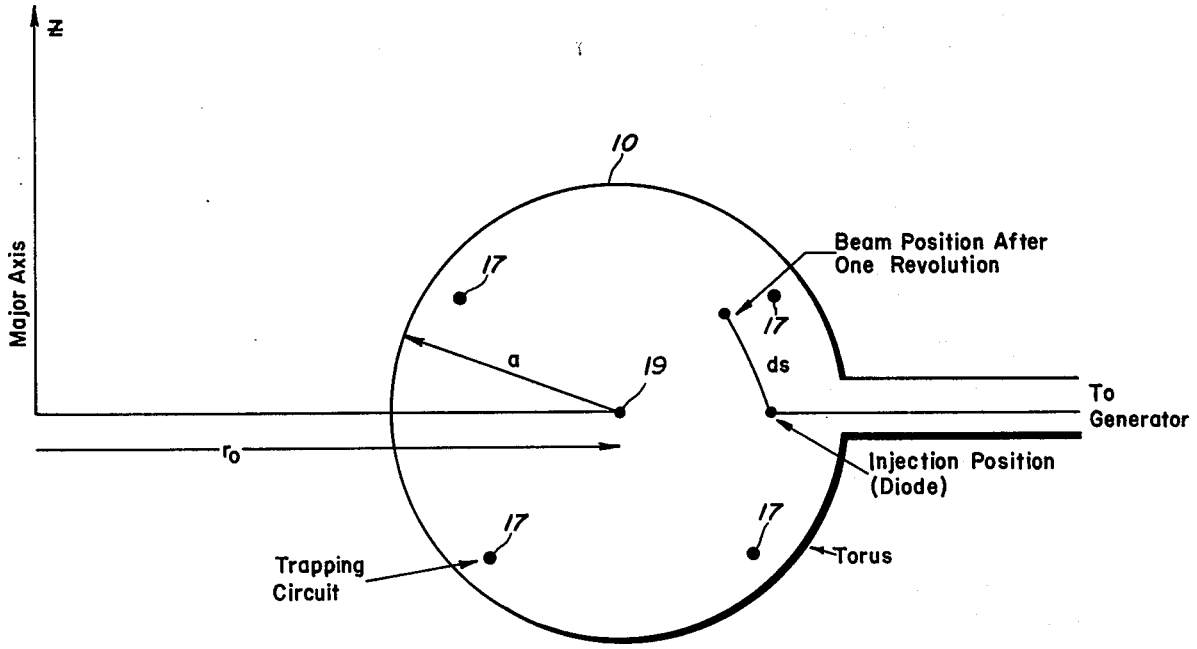
FIG. 2 is a cross-sectioned view of the toroid shown in FIG. 1.

Thus, after a revolution around the major axis of the torus, the beam will come back to hit the injector. However, it has been discovered that if the value of the betatron field is a few percent different than its equilibrium value, i.e. mismatched, the center of the beam will drift away from the injector as the beam propagates along the torus. The distance ds the beam will drift in one revolution is given by $$ds = 4\pi r_o \left(\frac{B_{oz}}{B_{o\theta}}\right)\left(\frac{c}{\Omega_{oz}}\right)\left(\frac{\nu}{\gamma_o^2 a^2}\right)\left(\frac{\rho}{1-\rho^2/a^2}\right),$$

where $r_o$ is the major radius, $B_{oz}$ is the value of betatron field at the center of the minor cross-section of the torus, $B_{o\theta}$ is the value of toroidal field at $r_o$, $\Omega_{oz}=eB_{oz}/m_oc$, a is the minor radius of the torus and $\rho$ is the displacement of the center of the beam from the center of the torus. This distance ds is represented in FIG. 2, which is a cross-section view along the minor axis 19 of the torus 10. This mismatching of the initial betatron field $B_{oz}$ can be realized simply by injecting the beam with a different time delay than that corresponding to $B_{oz}$. In the computer simulation of FIGS. 3 and 4, the equilibrium value of $B_{oz}$ is 152 gauss (FIG. 3) and the mismatched value of $B_{oz}$ is 146 gauss (FIG. 4).

If the betatron magnetic field remains constant in time or both the flux and the local magnetic field vary in sychronism, the beam would drift and come back to the injector after a bounce period or approximately after 10–20 revolutions around the major axis 15. This is shown in the computer simulation results of FIG. 3. The values of the various parameters are listed in the margin of the figure. Shown in the figure is the projection of the center of the rotating beam in the r-z plane. It is apparent that the beam after about 250 nsec (one bounce period) comes back and strikes the injector. However, by slightly reducing the local magnetic field during the bounce period, the beam can be caused to drift away from the injector. This is shown in the computer simulation results of FIG. 4. The various parameters in that figure have the same values as those in FIG. 4, except that the value of the betatron field within a bounce period has been reduced by two gauss, i.e., from 146 to 144 gauss. If the fields then remain stationary in time after a bounce period, the center of the beam will continue rotating around the equilibrium position, which will remain stationary in time. However, if both the betatron field and the flux through the orbit increase at the same rate, the equilibrium position would move closer to the center of the minor cross section of the torus and the beam would rotate around the minor axis with a progressively smaller radius.

Circuitry for mismatching the betatron field value to cause the beam, as it bounces back, to drift away from the beam generation apparatus with a path as shown in FIG. 4 is easily implemented. By way of example, a set of three or four coils 17 may be disposed symmetrically inside and throughout the entire circumference of the toroid 10 as shown in FIG. 2. The coils 17 should be positioned to generate a small vertical magnetic field on the order of 2 Gauss in the same direction as the betatron field. A capacitive discharge circuit may then be utilized to energize these coils immediately after beam generation in the toroid for a bounce period which is typically on the order of 230–250 nanoseconds (the trapping stage) in order to move the beam away from the injector during the bounce period. It is especially advantageous to locate these field modifying coils 17 inside the toroidal chamber 10 because of the slow rate at which a magnetic field penetrates through conductors. The field set up by these modifying field coils will oppose the betatron magnetic field and yield a reduced resultant field which is not at equilibrium.

The use of the above-noted modifying field coils permits the modification of the local betatron field in the toroid 10 while allowing the maintenance of the approximately constant average flux within the orbit of the beam during the trapping stage.

Figure 5:
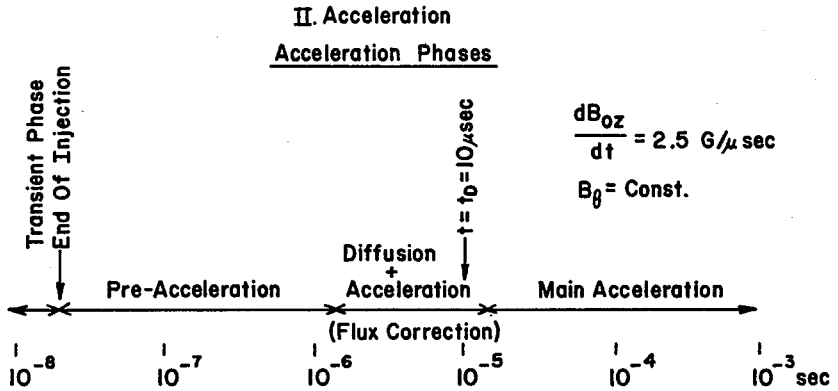
FIG. 5 is a time graph of the acceleration phases utilized in the present invention.

For a device having the same parameters as the simulation shown in FIG. 3, the current required to produce a two Gauss field is approximately 200 A and the total inductance (including the mutual inductance) is approximately 20 $\mu$H. The total energy in the magnetic field is less than a Joule and the voltage of the power supply that drives the current through the circuit over the 230–250 nsec time period is about 20 kV. After generation and trapping, the electron beam is accelerated to high energy by the inductive electric field generated by the time varying betatron magnetic field. This acceleration may be divided into three phases as shown in FIG. 5. These phases, i.e. pre-acceleration, diffusion, and main acceleration, are shown on a time graph in relation to the injection and trapping phase. The injection and trapping phase lasts approximately $2\times10^{-8}$. The next phase, the pre-acceleration phase, occurs for a time $t_p$ much shorter than the self field diffusion time, $t_D$, i.e.

$$t_p << t_D = \sigma\mu\delta b \ln\left(\frac{r_o}{b}\right), \tag{7}$$

where $\sigma$ is the conductivity and $\mu$ the permiability of the conductor surrounding the beam, $\delta$ is the thickness, a is the minor radius, and $r_o$ is the major radius of the toroid. The self magnetic field will not diffuse out instantaneously, but will require a predetermined time $t_D$ to diffuse through the toroidal walls. This diffusion time $t_D$ is required because eddy currents caused by the time varying B field are set up on the walls of the toroid and act to generate a magnetic field which acts to cancel the diffusing self magnetic flux. These eddy currents will then fade away due to the finite resistivity in the toroid walls. During this preacceleration time period when the self magnetic field of the beam has not had time to diffuse out of the conducting toroid, the wall acts as a perfect conductor and the condition for the major radius $r_o$ of the beam to remain constant can be derived from the conservation of canonical angular momentum. Through various mathematical manipulations of this angular momentum equation, it can be shown that the following condition must be satisfied in order for the radius of the accelerated electron ring to remain constant:

$$\frac{\partial B_{oz}(t)}{\partial t} = \frac{1}{2}\left[1 + \frac{2\nu}{\gamma_o^3}\left(1 + \ln\frac{a}{r_b}\right)\right]\frac{\partial}{\partial t}\langle B^{ext}\rangle \tag{8}$$

In this equation, $B_{oz}(t)$ is the local magnetic field, ($\nu$) is the Budker parameter, and $\langle B^{ext}\rangle$ is the average magnetic field. In essence, this equation is a restatement of the well known betatron flux rule with a correction factor $$\frac{2\nu}{\gamma_o^3}\left(1 + \ln\frac{a}{r_b}\right) \tag{9}$$

It can be seen that this correction factor is very sensitive to the beam energy due to the term $\gamma_o^3$) and can be neglected for high beam injection energies. For example, for a 10 kA, 3 MeV beam injected into a 10 cm minor radius torus with $r_b=1$ cm, the correction factor is only 1% and therefore can be neglected. In contrast, when the energy of the same beam is reduced to 0.5 MeV, the correction is 48%. Accordingly, the design of the accelerator may be significantly simplified by injecting a beam with a high energy.

The diffusion and acceleration phase occurs when the time approaches the field penetration time $t_D$, and the self magnetic field of the beam begins to diffuse out of the metal toroid chamber 10. For this diffusion and acceleration phase, it can be shown that for an electron beam located near the center of the toroidal chamber having an inner minor radius a, an outer minor radius b, major radius $r_o$, conductivity ($\sigma$), and thickness $(\delta)=b-a$, the self magnetic field of the beam in mks units is $$H_\theta(r,t) = \frac{1}{2\pi r}\left[1 - e^{-t/to}\right],\ r \geqq b \tag{10}$$

$$H_\theta(r,t) = \frac{1}{2\pi r},\ r_b \leqq r \leqq a$$

provided $\delta/a<<1, a_5\delta<<1$, $t_o=\sigma\mu\delta b\ln(r_o/b)$. The corresponding flux in the three regions is given by $$\phi = \begin{cases} \mu r_o I \ln(a/r_o)\ r \leqq a \\ 0\ a \leqq r \leqq b \\ \mu r_o I\left[1 - e^{-a52t/\sigma\mu}\right]\ln\frac{r_o}{b}\ r \geqq b \end{cases} \tag{11}$$

The rate at which the self flux diffuses out of the toroidal chamber 10 is then given by $$\frac{d\phi}{dt} = \frac{\mu r_o I}{t_D} e^{-t/tD} \ln\frac{r_o}{b}. \tag{12}$$

Figure 6:
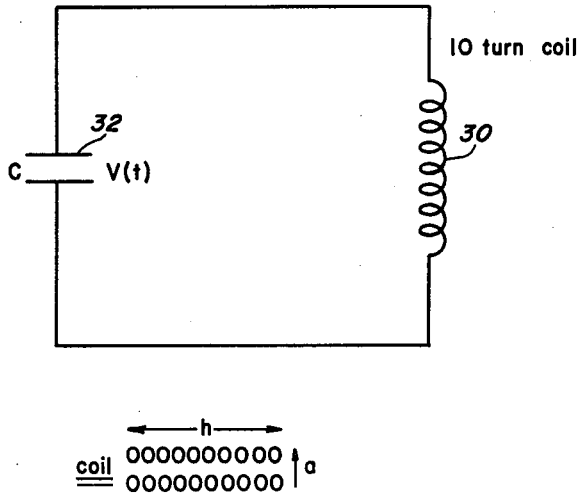
FIG. 6 is a schematic diagram of one circuit which may be utilized to produce the additional E field in the betatron.

During this short diffusion and acceleration phase, the changing flux caused by the diffusion of the self magnetic field induces an inductive E field as it diffuses through the toroid walls. This inductive E field opposes the motion of the beam and lasts only so long as the diffusion occurs. Although the time period during which this inductive E field opposes the motion of the beam is relatively short, because it is a high current beam the opposing force can be quite significant. Accordingly, circuitry has been provided to partially cancel this opposing field. In essence, the circuitry provides an E field which complements the accelerating betatron field. The generation of this complementing E field may be achieved quite simply by generating a changing magnetic field in the toroidal chamber 10 in a direction approximately perpendicular to the plane of the toroidal chamber to thereby induce an electric field in accordance with Maxwell's equation $\nabla X\ E=-(dB/dt)$ which cancels the opposing electric field caused by diffusion. Such a changing magnetic field can be obtained in one embodiment by inserting a coil 30 as shown in FIG. 6 into the center of the toroid with its axis coincident with the major axis for the toroid. This coil may be energized, by way of example, by discharging a capacitor 32 thereacross at the end of the beginning of the diffusion time, $t_o$, to thereby generate a changing magnetic field in a direction vertical to the plane of the toroid, thus complementing the betatron magnetic field $B_z$. The parameters for a typical circuit with a coil having 10 turns may be as follows: $L=2\times10^{-5}H$, $C=0.5\times10^{-5}F$, $V_o=3\ KV$, $I=1.5\ kA$, $\tau=(LC)^{\frac{1}{2}}=10\mu$ seconds, $\Delta\phi=V_o\tau$, and $V=V_oe^{-t/\tau}$ These parameters have been devised for a toroid with $r_o=lm$, $I=10\ kA$, $a=0.1\ m$ and $t_D=10\mu$ seconds.

The return magnetic flux from the coil is forced to return outside the beam orbit by two slotted conducting (parallel) discs, that are situated perpendicular to the major axis and have a radius greater than $r_o$. In essence, the beam radius is maintained approximately constant during the diffusion and acceleration phase by supplying additional flux at a rate smaller than that given by equation 11. Only partial cancellation of the opposing electric field is required because the toroidal effects (hoop stresses) increase during diffusion.

The previous discussion assumes that the electron ring is located at its equilibrium radius at the center of the torus and is therefore stationary. If the electron ring gyrates about the equilibrium orbit with a frequency $\omega_B$, the oscillating part of the self magnetic field of the beam will have different diffusion characteristics than the stationary self field components. The diffusion time associated with the oscillating electron ring is significantly faster than that of a stationary ring. That is, the oscillating component of the self magnetic field with frequency $\omega_B$, diffuses through the chamber wall with a substantially faster diffusion time than the stationary component of the self field. The consequences of the faster diffusion time associated with the oscillating field can be very important. For example, if the oscillating component of the self field diffused out, the nature of the drift oscillation of the electron ring would change. This change could result in unstable motion and loss of the electron ring. That is, it can be shown that there is stable ring oscillation if the bounce frequency $\omega_B$ is positive, and unstable oscillation if $\omega_B$ negative. If initially $\omega_B$ is positive, i.e., $$\omega_B=\frac{\Omega_{oz}}{\gamma_o}\ \frac{B_z}{B_\theta}\left[\frac{1}{2}-\frac{2\nu}{\gamma_o^3}\left(\frac{r_o^2}{a^2}\right)\right]>0$$

but then the oscillating field diffuses out, the bounce frequency could become negative because the second term in the bracket increases during diffusion. This reversal of the sign of $\omega_B$ would lead to a rather strong disruptive instability. It has been shown, however, that the oscillating self field component will not diffuse out if $\omega_B\tau_D>>1$, where $\tau_D=2\pi\delta^2\nu/c^2$ is the oscillating diffusion time, $\delta$ is the chamber thickness and $\nu$ the conductivity. Thus, it is prudent to design a modified betatron with parameters such that $\omega_B\tau_D>>1$. As an illustration we take $\delta\sim2$ mm, $\nu=2.5\times10^{15}\ sec^{-1}$ (stainless steel), $\omega_B^{-1}=50$ nsec, these parameters give $\omega_B\tau_D\approx15$. This value for $\omega_B\tau_D$ is sufficiently large to insure that (i) the oscillating self magnetic field will not diffuse out and (ii) the sign of $\omega_B$ will remain positive and hence stable.

During the main acceleration phase, the diffusion of the beams self field has terminated and the cancelling E field generated by the coil 30 has gone to zero. Likewise, the ratio $\nu/\gamma_o\rightarrow O$ and therefore the toroidal effects become negligible. Thus, the beam is accelerated entirely by the time varying betatron field $B_z$.

Figure 7:
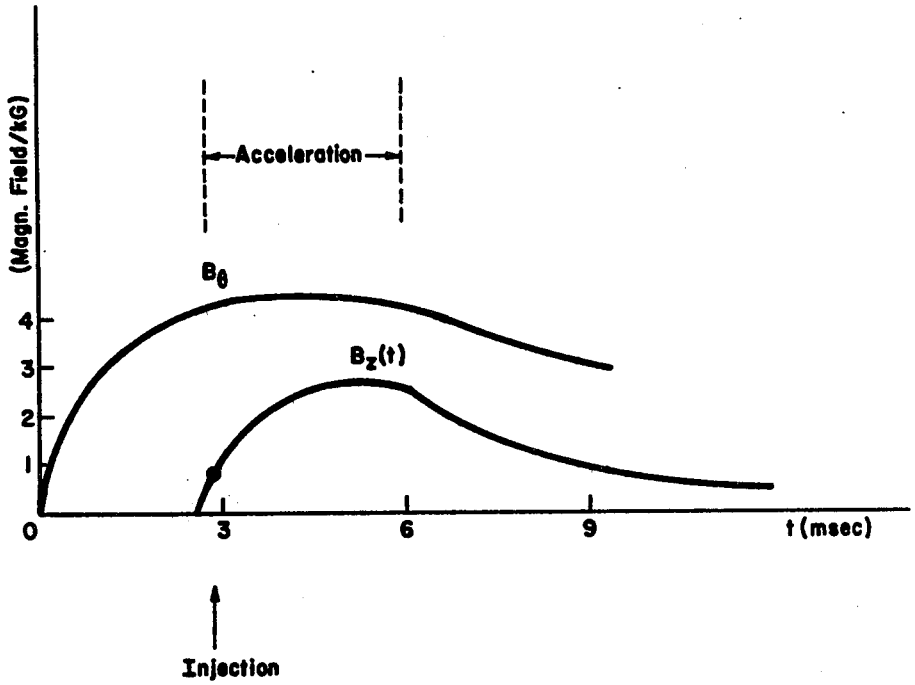
FIG. 7 is a graphical representation of typical toroidal and betatron magnetic fields versus time in milliseconds.
Figure 8:
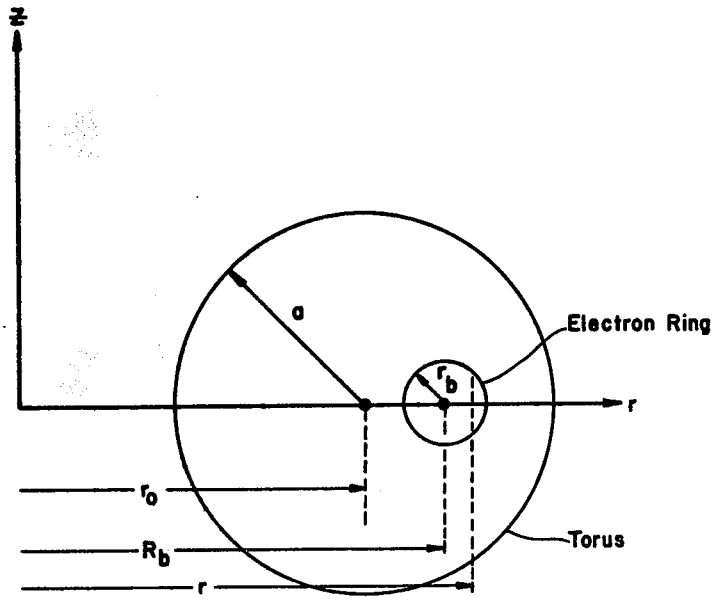

FIG. 7 graphically represents the variation of the toroidal magnetic field $B_\theta(t)$ and the betatron magnetic field $B_z(t)$ with respect to time. This figure can be juxtaposed against FIG. 5 which sets forth the various acceleration phases of the beam. The timing of these magnetic fields can be interpreted as follows. The toroidal field $B_\theta$ is turned on at a time $t=0$. This field may be generated, as noted above, by a set of coils wound around the minor diameter of the toroid. In actuality, these coils are disposed around the entire circumference of the toroid 10, although they are shown as only covering a small portion thereof to prevent undue complication of FIG. 1. When this toroidal field $B_\theta$ is near its peak, then the betatron vertical field $B_z$ is turned on. This betatron field constitutes the main acceleration field. When this betatron field is approximately one hundred gauss, the beam is injected with the preferred $\nu/\gamma$ ratio. It can be shown that during the main acceleration phase of the beam, the accelerated beam will move closer to the center of the minor cross section of the toroid as $B_\theta$ remains approximately constant.

There are numerous instabilities which limit the electron current in the modified betatron accelerator. In general these instabilities are strongest at the time of injection, when the beam energy is minimum. A number of these instabilities such as the negative mass, kink, longitudinal resistive wall and transverse resistive wall instabilities have been analyzed. As a general result, it is found that the addition of the toroidal magnetic field improves the stability characteristics of the intense electron ring, provided that the toroidal magnetic field is considerably greater than the vertical field, i.e. $|B_\theta|<<|B_z|$. However, in general the presence of the toroidal magnetic field is not sufficient to completely stabilize all the instabilities associated with an intense electron ring. Many of the instabilities can be further stabilized by an energy spread of the electrons. One of the unique features of the ultra high current modified betatron is that an energy spread does not disrupt the beam equilibrium. In contrast, in a low current betatron a beam energy spread can be very disruptive to the equilibrium. This point can be quantified by noting that if $\Delta\gamma/\gamma$ is the fractional energy spread, the increase in the minor radius of the ring in a high current modified betatron ($n_s>>1$) is given by $$\Delta r\sim(\Delta\gamma/\gamma/n_s)r_o$$

and for a low current betatron ($n_s<<1$) is given by $$\Delta r\sim2(\Delta\gamma/\gamma)r_o$$

where $n_s=2(r_o/r_b)^2\nu/\gamma^3$.

Clearly for a given $\Delta\gamma/\gamma$, the spread in the minor radius of the beam in a low current betatron is a greater than for a high current modified betatron. To summarize the stability aspects of the high current modified betatron accelerator, it has been shown that a large toroidal magnetic field together with a moderate energy spread ($\sim10\%$) have a significant stabilizing affect on the electron ring. Furthermore the high current modified betatron has the unique feature that a moderate energy spread is not necessarily disruptive to the beam equilibrium.

The present invention sets forth a conceptually simple scheme for significantly increasing the current in a betatron accelerator while maintaining the stability of the current beam. This beam with its high current causes the occurrence of significant toroidal effects which during injection, are used to offset the major radius reduction due to the decreasing beam energy $\gamma$. The amount of this offset may be controlled by adjusting the betatron magnetic field $B_z$.

As noted above, a disadvantage to the use of high current - high energy injected beams is that the diffusion of the self magnetic field from the beam will induce an electric field which will oppose the motion of the beam. This opposing electric field from the self field diffusion can be cancelled by means of an added electric field. Accordingly, the present method and means set forth a technique for permitting the injection of high current - high energy beams into a betatron accelerator without losing beam stability.

It should be noted that the high beam energy of the present system causes the charged particles in effect ot become heavier, thereby causing the growth rate of other instabilities such as negative mass to decrease.

Obviously many modification and variations of the present invention are possible in light of the above teachings. It is therefore to be understood that within the scope of the appended claims the invention may be practiced otherwise than as specifically described.

What is claimed and desired to be secured by Letters Patent of the United States is:

1. A betatron for accelerating charged particles, said betatron having a toroidal vacuum chamber in which particle acceleration takes place, comprising:

means for generating a betatron magnetic field for accelerating charged particles in said vacuum chamber;

means for generating a charged particle beam in said vacuum chamber;

means for generating an electric field to oppose the electric field induced by the diffusion of the self magnetic field of the beam; and means for energizing said electric field generating means for only the period during which the self magnetic flux diffuses out of said toroidal chamber.

2. A betatron as defined in claim 1, wherein said beam generating means includes means for injecting a charged particle beam with the ratio of the Budker parameter $\nu$ to the relativistic factor $\gamma$ of the beam in the range $\nu/\gamma=0.005$ to 0.25 such that toroidal field effects are significant.

3. A betatron as defined in claim 2, herein said electric field generating means comprises a circuit for generating a changing magnetic field in said toroidal chamber in a direction approximately perpendicular to the plane of said toroidal chamber to thereby induce said opposing electric field.

4. A betatron as defined in claim 3, further comprising means for generating a toroidal magnetic field in said toroidal chamber.

5. A betatron as defined in claim 4, wherein said electric field generating means comprises:

a coil disposed such that its axis is approximately coincident with the major axis of said toroidal chamber; and wherein said energizing means comprises means for driving a changing current through said coil for a predetermined period of time.

6. A betatron as defined in claim 5, wherein said driving means comprises a capacitor for discharging through said coil, and wherein said capacitor-coil time constant is approximately 10 microseconds.

7. A method for accelerating charged particles in a toroidal vacuum chamber comprising the steps of:

generating an accelerating betatron field relative to said toroidal chamber; and generating a charged particle beam in the chamber with the ratio $\nu/\Xi$ of the Budker parameter $\nu$ to the relativistic factor $\gamma$ of the beam on the order of 0.1 at a point in the betatron magnetic field cycle slightly less than the field equilibrium point for the beam.

8. A method for accelerating charged particles in a toroidalvacuum chamber comprising the steps of:

generating an accelerating betatron field relative to said toroidal chamber;

generating a charged particle beam in said chamber with a ratio of the Budker parameter $\nu$ to the relativistic factor $\gamma$ of the beam in the range of $\nu/\gamma=0.005$ to 0.25;

at a predetermined time approximately coincident with the beginning of the diffusion of the beam's self magnetic field out of said toroidal chamber and the induced electric field attendant thereto, generating an electric field in said toroidal chamber to oppose said induced electric field attendant to the magnetic field diffusion; and terminating said generated electric field when said induced electric field attendant to the magnetic field diffusion goes to approximately zero.

9. A method as defined in claim 8, further comprising the step of generating an azimuthal magnetic field in said toroidal chamber prior to said betatron field generating step.

10. A method as defined in claim 9, wherein said electric field generating step comprises the step of generating a changing magnetic field in said toroidal chamber in a direction approximately perpendicular to the plane of the chamber to thereby induce said opposing electric field.

11. A betatron for accelerating charged particles, said betatron having a toroidal vacuum chamber in which particle acceleration takes place, comprising:

means for generating a toroidal magnetic field within said toroidal chamber;

means for generating a betatron magnetic field for accelerating charged particles in said toroidal chamber;

means for generating a charged particle beam in said toroidal chamber;

means for modifying the local betatron field in said toroidal chamber during the beam trapping stage while maintaining the average flux inside the orbit of the beam constant; and first means for energizing said betatron field modifying means for only the period during the beam trapping stage.

12. A betatron as defined in claim 11, wherein said beam generating means comprises means for generating a charged particle beam with a ratio of the Budker parameter $\nu$ to the relativistic factor $\gamma$ of the beam in the range $\nu/\gamma=0.005$ to 0.25 such that toroidal field effects are significant.

13. A betatron as defined in claim 12, further comprising means for generating a field to oppose the electric field induced by the diffusion of the self magnetic field of the beam through the toroid; and second means for energizing said opposing electric field generating means for only the period during which the self-magnetic field diffuses out of the toroid.

14. A betatron as defined in claims 12 or 13, wherein said field modifying means comprises a set of coils disposed inside said toroidal chamber for generating a vertical magnetic field to oppose the betatron magnetic field of said betatron field generating means to thereby reduce the resultant vertical betatron field.

15. A betatron as defined in claim 14, wherein said first energizing means comprises a capacitive discharge circuit.

16. A method for accelerating charged particles in a toroidal vacuum chamber comprising the steps of:

generating a toroidal magnetic field within said toroidal chamber;

generating a betatron accelerating magnetic field relative to said toroidal chamber;

generating a charged particle beam in said toroidal chamber at a point in the betatron magnetic field cycle where the betatron field is slightly mismatched from the field equilibrium value for the beam;

modifying the betatron magnetic field in the toroidal chamber while maintaining the average flux inside the orbit of the beam constant to avoid collision with beam generation circuitry after a bounce period;

terminating the modification of the betatron magnetic field.

17. A method as defined in claim 16, wherein said beam generating step further comprises the step of generating a charged particle beam with a ratio of the Budker parameter $\nu$ to the relativistic factor $\gamma$ of the beam in the range $\nu/\gamma=0.005$ to 0.25.

18. A method as defined in claim 17, further comprising the steps of:

at a predetermined time approximately coincident with the beginning of the diffusion of the beam's self magnetic field out of the toroidal chamber and the induced electric field attendant thereto, generating an electric field in the toroidal chamber to oppose the induced electric field attendant to the magnetic field diffusion; and terminating said generated electric field when said induced electric field attendant to the magnetic field diffusion goes to approximately zero.

19. A method as defined in claim 17 or 18 wherein said beam generating step comprises the step of generating the beam at a point in the betatron magnetic field cycle where the betatron field is slightly less than the field equilibrium value for the beam; and wherein said modifying step comprises the step of generating a vertical magnetic field inside the toroidal chamber to oppose the betatron magnetic field to thereby reduce the resultant vertical betatron field; and terminating the vertical magnetic field of said modifying step when the charged particle beam is trapped.

* * * * *